US010807836B2

(12) United States Patent
Zhang et al.

(10) Patent No.: US 10,807,836 B2
(45) Date of Patent: Oct. 20, 2020

(54) CRANE WINDPROOF ANCHORING SYSTEM AND METHOD

(71) Applicants: QINGDAO PORT INTERNATIONAL CO., LTD., Qingdao, Shandong Province (CN); QINGDAO NEW QIANWAN CONTAINER TERMINAL CO., LTD., Qingdao, Shandong Province (CN)

(72) Inventors: Liangang Zhang, Qingdao (CN); Minghui Zheng, Qingdao (CN); Jiemin Yang, Qingdao (CN); Wei Zhang, Qingdao (CN); Wangyang Liu, Qingdao (CN); Yanchun Wang, Qingdao (CN); Zhaofu Wang, Qingdao (CN)

(73) Assignees: QINGDAO PORT INTERNATIONAL CO., LTD., Qingdao (CN); QINGDAO NEW QIANWAN CONTAINER TERMINAL CO., LTD., Qingdao (CN)

( * ) Notice: Subject to any disclaimer, the term of this patent is extended or adjusted under 35 U.S.C. 154(b) by 34 days.

(21) Appl. No.: 16/306,531

(22) PCT Filed: Jul. 28, 2017

(86) PCT No.: PCT/CN2017/094833
§ 371 (c)(1),
(2) Date: Nov. 30, 2018

(87) PCT Pub. No.: WO2018/205422
PCT Pub. Date: Nov. 15, 2018

(65) Prior Publication Data

US 2019/0185296 A1 Jun. 20, 2019

(30) Foreign Application Priority Data

May 12, 2017 (CN) ..... 2017 1 0331856

(51) Int. Cl.
*B66C 9/18* (2006.01)
*B66C 15/00* (2006.01)
(Continued)

(52) U.S. Cl.
CPC ..... *B66C 9/18* (2013.01); *B66C 13/00* (2013.01); *B66C 13/06* (2013.01); *B66C 15/00* (2013.01); *B66C 19/002* (2013.01); *B66C 13/18* (2013.01)

(58) Field of Classification Search
CPC ..... B66C 9/18; B66C 15/00; B66C 13/18; B66C 13/06; B66C 19/002; B66C 13/00
(Continued)

(56) References Cited

U.S. PATENT DOCUMENTS 5,537,778 A 7/1996 Bardwell et al.
6,349,503 B1 * 2/2002 Gompertz ..... E01F 13/028 49/34

FOREIGN PATENT DOCUMENTS

CN 102311049 1/2012
CN 104210959 12/2014
(Continued)

OTHER PUBLICATIONS

Translation of CN 102311049 document obtained via website: https://worldwide.espacenet.com on Feb. 25, 2020.*
NPL document CN 200946067 dated Sep. 12, 2007.*

*Primary Examiner* — Pamela Rodriguez
(74) *Attorney, Agent, or Firm* — Jiwen Chen; Jacobson Holman PLLC

(57) ABSTRACT

The invention discloses a wind protection anchoring system for a bridge crane and a method, wherein the system
(Continued)

comprises four wind protection pull rods mounted on the bridge crane and four ground wind protection foundations corresponding to the four wind protection pull rods; the wind protection pull rod comprises a pull rod body, a pull rod nut, a driving device and a lock pin; the pull rod nut is connected to the pull rod body with threads thereon and mounted on the bridge crane; the top end of the pull rod body is fixedly provided with a driven device and the bottom end is connected to a lock pin; a lock pin fixing groove is formed on the ground wind protection foundation, at which mounted a fixing plate opened with a first opening and a second opening; the driving device is driven by the wind protection anchoring control module to enable the pull rod body to descend and enter into the lock pin fixing groove through the second opening, and enable the pull rod body to ascend and being blocked by the first opening to as the bridge crane at the anchorage, thereby fixedly connecting the pull rod body and the ground wind protection foundation.

10 Claims, 5 Drawing Sheets

(51) Int. Cl.

| | |
|---|---|
| ***B66C 19/00*** | (2006.01) |
| ***B66C 13/00*** | (2006.01) |
| ***B66C 13/06*** | (2006.01) |
| ***B66C 13/18*** | (2006.01) |

(58) Field of Classification Search
USPC ..... 188/43, 44, 60, 158, 162, 165; 52/166, 52/167.1, 167.6, 167.7, 167.8
See application file for complete search history.

(56) References Cited

FOREIGN PATENT DOCUMENTS

| | | | |
|---|---|---|---|
| CN | 205023763 | | 2/2016 |
| JP | 2002-68665 A | * | 3/2002 |
| JP | 2006160456 | | 6/2006 |

* cited by examiner

CRANE WINDPROOF ANCHORING SYSTEM AND METHOD

This is a U.S. national stage application of PCT Application No. PCT/CN2017/094833 under 35 U.S.C. 371, filed Jul. 28, 2017 in Chinese, claiming priority of Chinese Application No. 201710331856.0, filed May 12, 2017, all of which are hereby incorporated by reference.

TECHNICAL FIELD

The invention belongs to the technical field of port automation, in particular to a wind protection anchoring system for bridge crane to resist wind damage, and a method thereof.

BACKGROUND

Bridge crane is an indispensable type of dockside lifting machine for container terminals, and it has the advantages of being automated, equipped with remote control system and noncontact in the application of automation to operate the container terminal.

According to safety guidelines for large-scale port machinery issued by Transportation Ministry, large-scale loading and unloading machinery operating in port must be equipped with wind protection device and the anti-overturning device to withstand the impact of high wind. But traditionally, both of the anchoring operation and the anti-overturning operation for large-scale machinery merely rely on manual work. On one hand, it requires more manpower and longer working time; on the other hand, it does not conform to the characteristics of port automation.

BRIEF SUMMARY

In one aspect this invention relates to a wind protection anchoring system and a wind protection anchoring method to realize an automatic wind protection anchoring process at automated container ports.

Provided is a wind protection anchoring system for bridge crane, which comprises a bridge crane, four wind protection pull rods respectively mounted on sides of the bridge crane on the sea end and the shore end, and four ground wind protection foundations corresponding to the four wind protection pull rods; wherein the ground wind protection foundations are formed on the solid foundations of the port; further comprises a wind protection anchoring control module; wherein the wind protection pull rod comprising a pull rod body, a pull rod nut, a driving device and a lock pin; wherein the driving device is connected to a control output end of the wind protection anchoring control module, a driven device is mounted on the top end of the pull rod body in cooperation with the driving device; relying on this structure, the driving device allows the driven device to rotate to activate the rotation of the pull rod body at its own axis; the pull rod body is provided with threads on its surface and the pull rod nut is connected to the pull rod body with the threads; the pull rod nut is fixed on the bridge crane and the lock pin is fixed on the bottom end of the pull rod body; the ground wind protection foundation is provided with a lock pin fixing groove; the slot of the lock pin fixing groove is provided with a fixing plate, and the fixing plate is opened with a first opening and a second opening adjacent to the first opening, wherein the area of the first opening is smaller than that of the second opening, such that the locking pin could enter into the locking pin fixing groove via the second opening as descending, and then being moved to the position below the first opening where the locking pin could not ascend due to blocking of the first opening; the wind protection anchoring control module is configured to activate the driving device; the driving device enables the driven device to drive the pull rod body revolve and descend relative to the pull rod nut until the locking pin enters into the lock pin fixing groove through the second opening of the ground wind protection foundation; after the bridge crane is being controlled to move to an preset anchorage along the direction from the second opening to the first opening of the ground wind protection foundation, the wind protection anchoring control module drives the driving device to act along a reverse direction to enable the pull rod body to ascend; the driving device stops until the pull rod body reaching to a wind protection anchoring height where the locking pin is restricted in the lock pin fixing groove due to the block of the first opening, so that the pull rod body is secured to the ground wind protection foundation.

Further, the wind protection anchoring system comprises a limiting detecting device and a bridge crane position detecting device, wherein the limiting detecting device includes a position sensor and a limiting rod, the limiting rod is mounted at the lower end of the pull rod nut and is provided with an anchor releasing height mark, a wind protection anchoring height mark and a plug-in height mark from top to bottom; the position sensor is connected to the wind protection anchoring control module and mounted on the pull rod body.

Further, the driving device comprises a first driving motor or a first driving hydraulic motor and a first driving gear, wherein the driven device is a long straight-cut gear meshing with the first driving gear, the assembly of the driven device and the driving device is based on the engagement of the long straight-cut gear and the first driving gear; the first driving motor or the first driving hydraulic motor is configured to drive the first driving gear to rotate; or the driven device comprises a driven gear and a multi-faced cylinder and the driven gear is sleeved on the periphery of the multi-faced cylinder and the multi-faceted cylinder is fixedly arranged on the top end of the pull rod body, the driving device comprises a second driving motor or a second driving hydraulic motor and a second driving gear, the assembly of the driven device and the driving device is based on the engagement of the driven gear and the second driving gear; the second driving motor or the second driving hydraulic motor is configured to drive the second driving gear to rotate.

Further, a fine adjustment device is arranged on the pull rod body, which is configured to adjust the length of the pull rod body.

Further, a torque sensor is installed on the driving device, which is connected to the wind protection anchoring control module and configured to detect the driving torque on the driving device.

Further, the wind protection anchoring system comprises a bridge crane position detecting device; the bridge crane position detecting device includes a positioning detecting antenna and positioning sensing components; wherein the positioning detecting antenna is mounted on the bridge crane and connected to the wind protection anchoring control module, which is configured to determine the positions of the positioning sensing components; the positioning sensing components are arranged on the ground beneath the bridge crane indicating the anchor position.

Further, the wind protection anchoring system for bridge crane further comprises a brake device connected to the wind protection anchoring control module, which is configured to make the driving device be fully stopped as the wind protection anchoring process completes.

Further, the wind protection anchoring system further comprises an anti-displacement anchoring device, the anti-displacement anchoring device comprises an anchoring groove, an anchoring plate, an anchoring plate cylinder and an anchoring position sensing device; wherein the anchoring groove is disposed on the dock foundation corresponding to the sea side or the shore side of the bridge crane; the anchoring plate cylinder is connected to the anchoring plate for enabling the anchoring plate to insert into or remove from the anchoring groove; the anchoring positioning sensing device is configured to determine if the anchoring plate inserts into the anchoring groove or removes from the anchoring groove.

Further provided is a wind protection anchoring method for bridge crane applied into the wind protection anchoring system described above, comprising: receiving a wind protection anchoring command; determining whether all of the four wind protection pull rods are correctly being aligned with the four ground wind protection foundations; activating the driving device if all of the four pull rods being right above their corresponding ground wind protection foundations to enable the driven device to drive the pull rod body to rotate and descend relative to the pull rod nut; determining whether the length of the lock pin extending into the locking pin fixing groove reaches to the preset length; if yes, determining whether the bridge crane is at the anchorage; if yes, activating the driving device to work along a reverse direction to enable the pull rod body to ascend; detecting the driving torque on the driving device and determining whether the driving torque reaches to the set torque; if yes, stopping the driving device and maintaining the lock pin being blocked by the first opening in the lock pin fixing groove to fixedly connect the pull rod body and the ground wind protection foundation.

Further, after the pull rod body is being fixedly connected to the ground wind protection foundation, the method further comprises: receiving a releasing anchoring command; activating the driving device to enable the driven device to drive the pull rod body to rotate and descend relative to the pull rod nut; determining whether the lock pin reaches to the preset length that the lock pin should extend into the lock pin fixing groove; if yes, determining if the bridge crane moves to a preset release anchoring position; if yes, enabling the driving device to rotate along a reverse direction to drive the pull rod body to ascend relative to the pull rod nut; determining whether the lock pin reaches to the anchor releasing height; if yes, stopping the driving device to release the connection between the pull rod body and the ground wind protection foundation.

Compared with the prior art, in the wind protection system and method provided by the present invention, a wind protection anchoring command could be issued and sent to the wind protection control module based on remote control or local control. After the determination that all of the four wind protection pull rods are correctly being aligned with the four ground wind protection foundations based on the detection of the bridge crane position detecting device, the driving device is being activated to enable the driven device in cooperation to drive the pull rod body to rotate and descend relative to the pull rod body until the lock pin at the bottom of the pull rod body entering into the lock pin fixing groove and reaches to the plug-in height. Then the bridge crane is being controlled to move to the anchorage relative to the ground wind protection foundation where the driving device is being controlled to act in a reverse direction by the wind protection control module to enable the pull rod body to ascend until abutting the fixing plate due to the block of the first opening which could be detected by the torque sensor or the position sensor, then stopping the driving device to enable the pull rod to be fixedly connected to the ground wind protection foundation, thereby preventing the bridge crane from turning over subject to heavy load; after the wind protection anchoring process, the anchoring plates are inserted into the anchoring grooves to prevent the bridge crane from sliding. All of the process and procedures are executed automatically and no operators are required, thereby improving the working efficiency and reducing the maintenance cost.

These and other objects and advantages of the present invention will appear hereinafter as this disclosure invention, reference being had to the accompanying drawings.

DETAILED DESCRIPTION

Embodiments of the present invention will be described in further detail with reference to the accompanying drawings.

Figure 1:
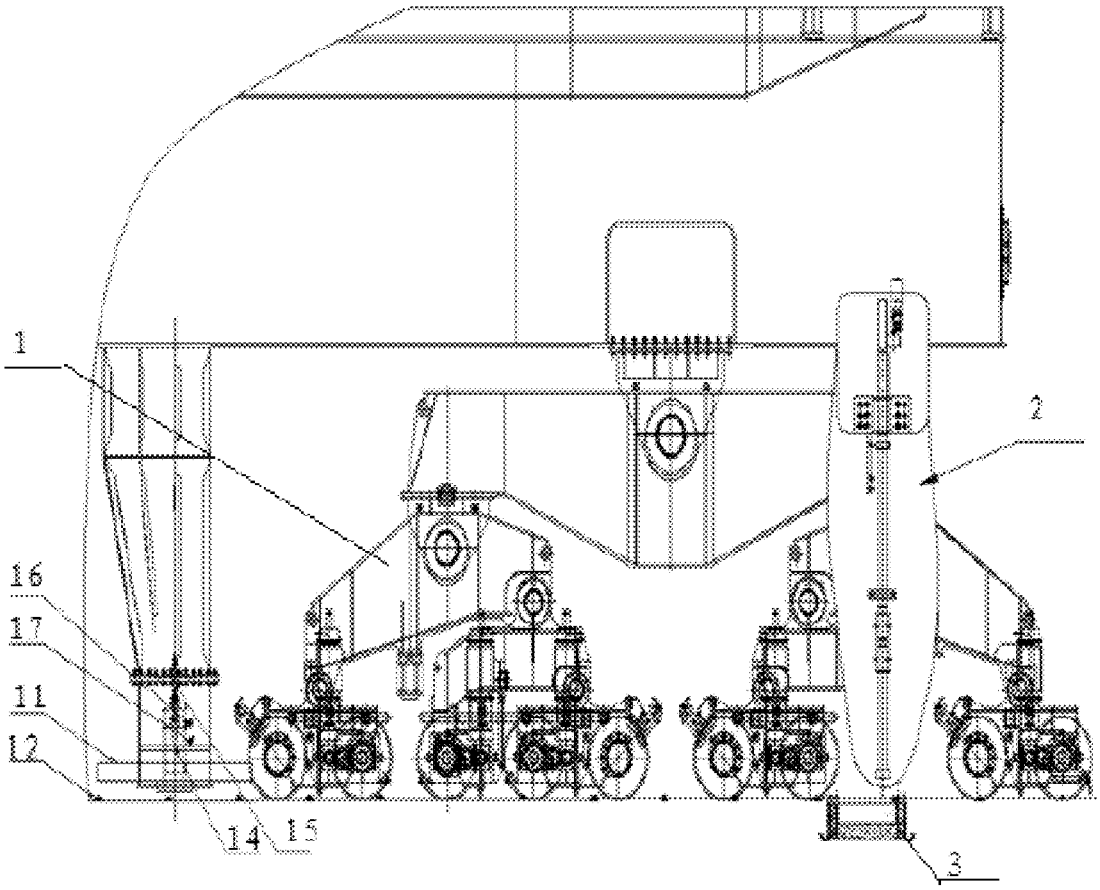
FIG. 1 is a schematic view of a wind protection anchoring system for bridge crane according to one embodiment of the present invention.

FIG. 1 shows a wind protection anchoring system configured to prevent a bridge crane from tipping or overturning subject to environment loads according to one embodiment of the present invention, comprising a bridge crane 1, four wind protection pull rods 2 (only one of the four shown in FIG. 1) mounted on lateral sides of the bridge crane both at the sea end and the shore end respectively, four ground wind protection foundations 3 (only one of the four shown in FIG. 1) corresponding to the four wind protection pull rods 2 and a wind protection anchoring control module (not shown); wherein the ground wind protection foundations 3 are formed on the solid foundation of the port.

Figure 2:
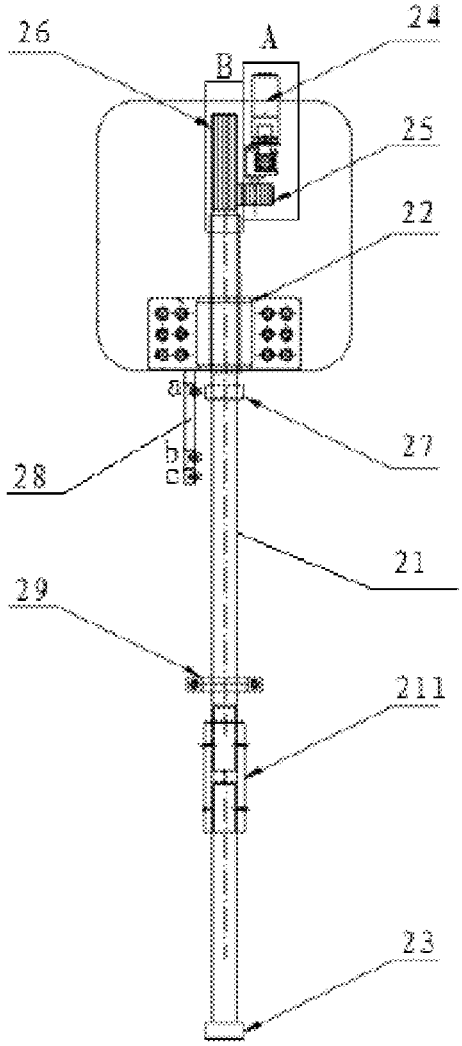
FIG. 2 is a schematic view of a wind protection pull rod according to one embodiment of the present disclosure.

FIG. 2 shows a specific structure of the wind protection pull rod, which comprises a pull rod body 21, a pull rod nut 22, a driving device A and a lock pin 23; wherein the driving device A is connected to a control output end of the wind protection anchoring control module, a driven device B is mounted on the top end of the pull rod body 21 in cooperation with the driving device A. Relying on this structure, the driving device allows the driven device to rotate to activate the rotation of the pull rod body 21 at its own axis. The pull rod body 21 is provided with threads on its surface and the pull rod nut 22 is connected to the pull rod body 21 with the threads. The pull rod nut 22 is fixed on the bridge crane and the lock pin 23 is fixed on the bottom end of the pull rod body 21.

Figure 4:
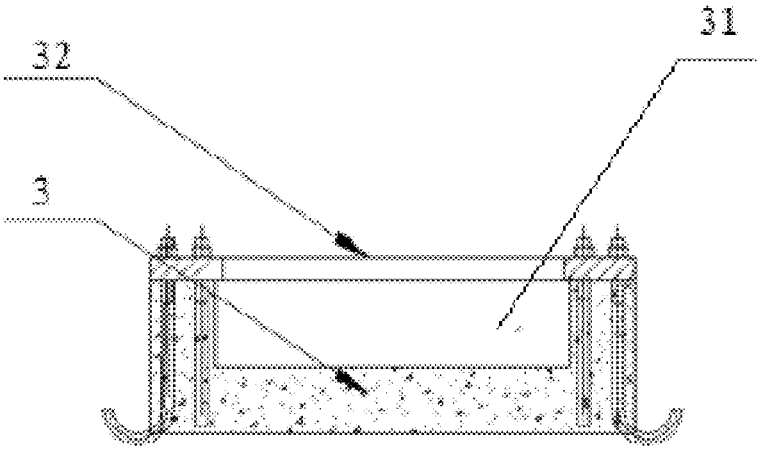
FIG. 4 is a schematic view of a ground wind protection foundation according to one embodiment of the present disclosure.
Figure 5:
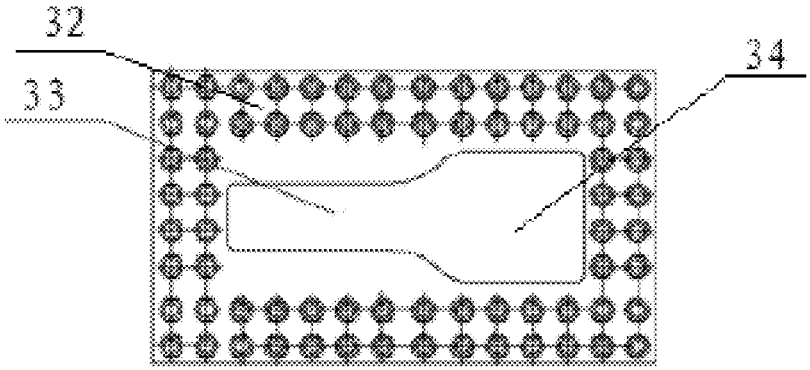
FIG. 5 is a top view of the FIG. 4.

As shown in FIG. 4 and FIG. 5, the ground wind protection foundation 3 is provided with a lock pin fixing groove 31. The slot of the lock pin fixing groove 31 is provided with a fixing plate 32, and the fixing plate 32 is opened with a first opening 33 and a second opening 34 adjacent to the first opening 33, wherein the area of the first opening 33 is smaller than that of the second opening 34 while the area of the second opening 34 is larger than the cross-sectional area of the locking pin 23 and the area of the first opening 33 is smaller than the cross-sectional area of the locking pin 23. Such that the locking pin 23 could enter into the locking pin fixing groove 31 via the second opening 34 as descending, and then horizontally move to the position below the first opening 33 where the locking pin 23 could not ascend due to the block of the first opening, accordingly the pull rod body 21 is connected to the ground wind protection foundation. Therefore, the bridge crane is secured to withstand the effects of high wind and forestall being overturned.

The wind protection anchoring control module is configured to activate the driving device A after receiving a wind protection anchoring command. The driving device A enables the driven device B to drive the pull rod body 21 to revolve and descend relative to the pull rod nut 22 until the locking pin 23 enters into the lock pin fixing groove 31 through the second opening 34 of the ground wind protection foundation 3, then the bridge crane is being controlled to move towards an preset anchorage along the direction from the second opening 34 to the first opening 33 of the ground wind protection foundation 3. After the bridge crane moving to the preset anchorage, the wind protection anchoring control module drives the driving device A to act along a reverse direction, then the driven device B also acts along a reverse direction to enable the pull rod body 21 to ascend. The driving device A stops until the pull rod body 21 reaches to a wind protection anchoring height where the lock pin locking pin 23 is restricted in the lock pin fixing groove 31 due to the block of the first opening 3. The pull rod body is secured to the ground wind protection foundation.

The bidirectional motion of the driving device A is being controlled by the wind protection anchoring control module, the specific directions of the movement are not limited in this embodiment. The control of the bridge crane could be performed with an independent bridge crane control system, or could be performed with the wind protection anchoring control module disclosed by the present invention. The wind protection anchoring command is a remote signal, to be specific, the wind protection anchoring control module is wirelessly connected to or being cabled to a remote control system and is being directly controlled by the remote control system.

The driving device A comprises a first driving motor or a first driving hydraulic motor, as the numeral symbol 24, and a first driving gear 25 as shown in FIG. 2. The driven device B is a long straight-cut gear 26 meshing with the first driving gear 25. The assembly of the driven device B and the driving device A is based on the engagement of the long straight-cut gear 26 and the first driving gear 25. The first driving motor or the first driving hydraulic motor 24 is configured to drive the first driving gear 25 to rotate, and the first driving gear 25 transmits the rotational motion to the long straight-cut gear 26 so as to further drive the pull rod body 21 to revolve at its own axis. In the process, the pull rod body 21 moves upwards or downwards as the first driving gear 25 moves upwards or downwards relative to the long straight-cut gear 26 during which the first driving gear 25 keeps mesh with the long straight-cur gear 2.

Figure 3:
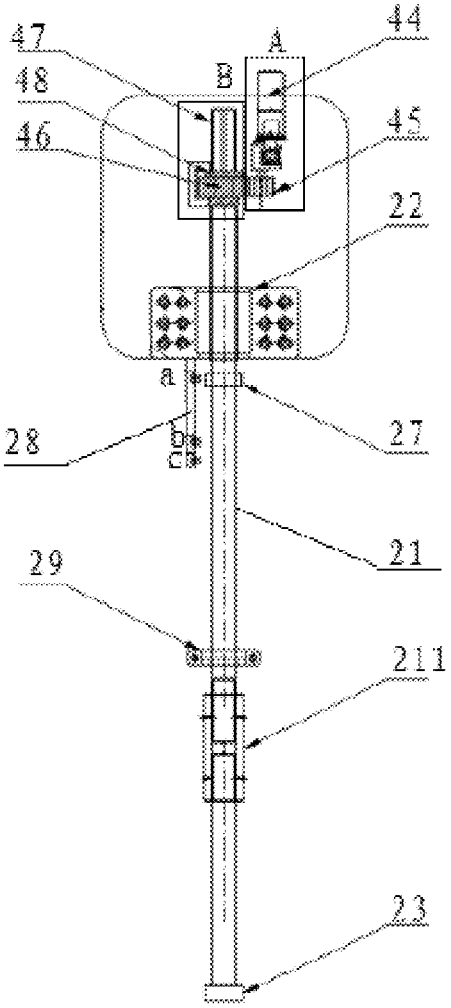
FIG. 3 is a schematic view of a wind protection pull rod according to another embodiment of the present disclosure.

Alternatively, as shown in FIG. 3, the driving device A comprises a second driving motor or a second driving hydraulic motor, as the numeral symbol 44, and a second driving gear 45. The driven device B comprises a driven gear 46 and a multi-faced cylinder 47, wherein an inner polyhedron sleeve 48 is installed within the driven gear 46, with which the driven gear 46 is sleeved on the periphery of the multi-faced cylinder 47 and the multi-faceted cylinder 47 is fixedly arranged on the top end of the pull rod body 21. The assembly of the driven device B and the driving device A is based on the engagement of the driven gear 46 and the second driving gear 45. The second driving motor or the second driving hydraulic motor 44 is configured to drive the second driving gear 45 to rotate, and the second driving gear 45 transmits the rotational motion to the driven gear 46 so that the multi-faced cylinder 47 rotates based on the sleeve connection with the driven gear 46, and the pull rod body 21 is being driven to revolve at its own axis. In the process, the pull rod body 21 moves upwards or downwards as the second driving gear 45 moves upwards or downwards relative to the multi-faced cylinder 47 during which the second driving gear 45 keeps mesh with the driven gear 46.

The wind protection anchoring system disclosed by the present invention further comprises a limiting detecting device and a bridge crane position detecting device, wherein during the anchoring process, the limiting detecting device is configured to measure the upward stroke or the downward stroke of the pull rod body, and the bridge crane position detecting device is configured to determine the current location of the bridge crane; both of the output signals are used for further control. As shown in FIG. 2 and FIG. 3, the limiting detecting device includes a position sensor 27 and a limiting rod 28, wherein the limiting rod 28 is mounted at the lower end of the pull rod nut 22. The limiting rod 28 is provided with an anchor releasing height mark a, a wind protection anchoring height mark b and a plug-in height mark c from top to bottom. The position sensor 27 is connected to the wind protection anchoring control module. The anchor releasing height mark a indicates a status that the lock pin 23 is being retracted from the lock pin fixing groove 31, the wind protection anchoring height mark b indicates the status that the lock pin 23 is at the highest point within the lock pin fixing groove 31, and the plug-in height position c indicates a preset stroke length that the lock pin 23 should extend into the lock pin fixing groove 31. If the position sensor 27 detects the presence of the anchor releasing height mark a, it is allowed to release the wind protection anchoring system; if the position sensor 27 detects the presence of the wind protection anchoring height mark b, it represents the completion of the anchoring process; if the position sensor 27 detects the presence of the plug-in height mark c, it stands for the intermediate status that the lock pin extends to a preset position inside the lock pin fixing groove 31. As shown in FIG. 1, the bridge crane position detecting device includes a positioning detecting antenna 11 and a plurality of positioning sensing components 12, wherein the positioning detecting antenna 11 is mounted on the bridge crane and connected to the wind protection anchoring control module, which is configured to determine the positions of the positioning sensing components 12. All of the positioning sensing components 12 are arranged on the ground at a preset interval, each of them marks a specific position where the bridge crane might move to and one of them indicates an anchor position. If the positioning detecting antenna 11 detects the presence of the one positioning sensing component indicating the anchor position, it could be determined that the wind protection pull rod 2 is be correctly aligned with the ground wind protection foundation and the wind protection anchoring process is permitted.

Further, the completion of the wind protection anchoring process could be determined based on the detection of a torque sensor installed on the driving device A. The torque sensor is connected to the wind protection anchoring control module and configured to detect the driving torque on the driving device. If the measured driving torque on the driving device reaches to a preset torque which recorded under the condition that, due to the block of the first opening 33, the locking pin 23 abuts the fixing plate 32 in ascending without extending out of the locking pin fixing groove 31, it indicates that the wind protection anchoring process completes. Therefore, the wind protection anchoring system could fully perform in the aspects of wind resistance and anti-overturning.

As shown in FIG. 2 and FIG. 3, in order to prevent the pull rod body 21 from deflecting in moving upwards or downwards, which may further result in the failure of the overall wind protection anchoring process, the pull rod body 21 is sleeved with a guiding ferrule 29. The guiding ferrule 29 is fixedly arranged on the bridge crane and configured to guide the motion path of the pull rod body. In another aspect, a fine adjustment device 211 is arranged on the pull rod body 21, which is configured to compensate for the error of the length of the pull rod body generating in the settling of the dock or in its own rotation.

The wind protection anchoring system for bridge crane further comprises a brake device connected to the wind protection anchoring control module, which is configured to make the driving device fully stopped as the wind protection anchoring process completes so as to ensure none of the wind protection pull rods are loosened in the anchoring process or at the time of releasing the anchor.

The wind protection pull rods are important in withstanding the effect of high wind and preventing the bridge crane from turning over. Besides the pull rods, the wind protection anchoring system disclosed in this embodiment further comprises an anti-displacement anchoring device, which is configured to prevent the bridge crane from sliding along the rail in the anchoring process. To be specific, the anti-displacement anchoring device (only one of them shown in the FIG. 1) comprises an anchoring groove, an anchoring plate 14, an anchoring plate cylinder 15 and an anchoring position sensing device, wherein the anchoring position sensing device comprises a plug-in position sensor 16 and a pull-out position sensor 17, which are also shown in the FIG. 1. The anchoring groove may be disposed on the dock foundation corresponding to the sea side or the shore side of the bridge crane; the anchoring plate cylinder 15 is connected to the anchoring plate 14 for enabling the anchoring plate 14 to insert into or remove from the anchoring groove. The anchoring positioning sensing device is connected to the bridge crane control system or to the wind protection anchoring control module disclosed by the present invention, which is configured to determine if the anchoring plate 14 inserts into the anchoring groove or removes from the anchoring groove. The control of the anchoring plate cylinder 15 could be performed with the wind protection anchoring control module disclosed by the present application, or be performed with the bridge crane control system, which is not limited in the present invention.

Based on the above-mentioned wind protection anchoring system disclosed by the present invention, a wind protection anchoring method for bridge crane is further provided. The method will be described in a detailed way with reference to the anchoring system as mentioned.

Figure 6:
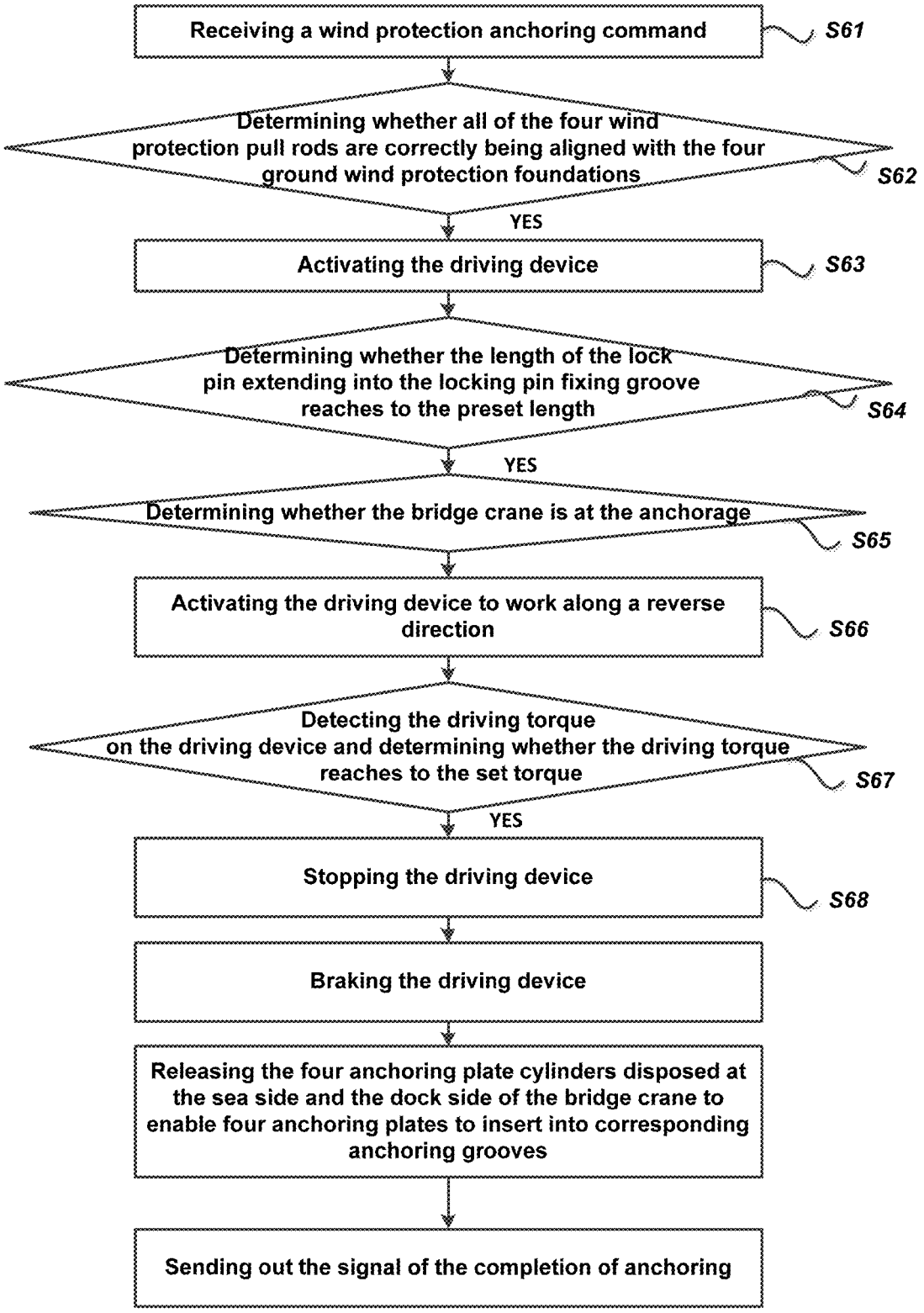
FIG. 6 is a flow chart showing a wind protection anchoring method according to one embodiment of the present invention.

As shown in FIG. 6, the wind protection anchoring method for bridge crane comprises: Step S61: Receiving a wind protection anchoring command.

In this embodiment, the wind protection anchoring command is issued and sent by a remote control system which is wirelessly connected to or cabled to the wind protection anchoring control module.

Step S62: Determining whether all of the four wind protection pull rods are correctly being aligned with the four ground wind protection foundations.

After receiving the wind protection anchoring command, firstly determining the current position of the bridge crane based on the detection of the bridge crane position detecting device; if the bridge crane is at a set anchor position, performing the wind protection anchoring process otherwise moving the bridge crane to the anchor position in advance; wherein at the set anchor position, the pull rods are properly right above corresponding second openings of the ground wind protection foundations.

Step S63: Activating the driving device if all of the four pull rods are right above their corresponding ground wind protection foundations.

With reference to the driving device as shown in FIG. 2 as an example, in this embodiment it defines that a forward motion means to drive the pull rod body to descend and a reverse motion means to drive the pull rod body to ascend. As all of the four wind protection pull rods are right above their corresponding ground wind protection foundations, the first driving motor or the first driving hydraulic motor is being activated to rotate forwards and drive the first driving gear to rotate along a forward direction. The first driving gear transmits the forward rotation to the long straight-cut gear through the engagement, and then the pull rod body is driven to revolve at its own axis and descend relative to the pull rod nut, namely moving close to the ground. The directions forward and reverse are merely relative to each other but not to be limited.

Step S64: Determining whether the length of the lock pin extending into the locking pin fixing groove reaches to the preset length.

As the wind protection pull rod is driven to move downwards, the position sensor detects the presence of the plug-in height mark c; if the plug-in height mark c is not being detected, the lock pin is still out of the lock pin fixing groove; if the presence of the plug-in height mark c is being detected, the lock pin has entered into the lock pin fixing groove through the second opening with a comparatively larger area and reached to the preset length. A preferable preset length should ensure the condition that as the lock pin reaches to the position and maintains at the position, enough space could be reversed to prevent the lock pin from abutting the bottom of the lock pin fixing groove. If the length of the lock pin extending into the locking pin fixing groove reaches to the preset length, stopping the driving device and performing the next step, Step S65: Determining whether the bridge crane is at the anchorage.

After the driving device is stopped, the bridge crane is being moved along the direction to the first opening which has a comparatively smaller area so that the lock pin also moves to the first opening with the bridge crane; during which if it is determined that the bridge crane is at the anchorage based on the detection of the bridge crane position detecting device, performing the next step.

Step S66: Activating the driving device to work along a reverse direction.

The first driving motor rotates reversely, so that the first driving gear also rotates along the reverse direction to drive the rod body to ascend relative to the pull rod nut, during which the lock pin moves towards the first opening until being blocked by the first opening on the fixing plate and abutting the fixing plate.

Step S67: Detecting the driving torque on the driving device and determining whether the driving torque reaches the set torque.

The detected driving torque of the torque sensor is being monitored in the process of the reverse rotation of the first driving motor. If the detected driving torque reaches the set torque, it means that the force between the fixing plate and the lock pin abutting the fixing plate meets a setting requirement of wind resistance to secure the bridge crane, and then performing the next step.

Step S68: Stopping the driving device and maintaining the lock pin being blocked by the first opening in the lock pin fixing groove, thereby fixedly connecting the pull rod body and the ground wind protection foundation.

As the first driving motor stops, the brake device further prevents the wind protection pull rod from rotating or moving. If the presence of the wind protection anchoring height mark b is being detected, an anchoring status signal is being sent back to the wind protection anchoring control module.

As the anchoring of the pull rod is finished, the anti-displacement anchoring device releases the four anchoring plate cylinders disposed at the sea side and the dock side of the bridge crane to enable four anchoring plates to insert into corresponding anchoring grooves. If the presence of the anchoring plates is detected by the anchoring position sensing device, a plug-in positional signal is sent back to the wind protection anchoring control module.

Thus, the four wind protection pull rods and the four anchoring plates of the bridge crane are simultaneously anchored, and the wind protection anchoring system ensures that the bridge crane in a wind protection anchoring state is prevented from turning over and sliding subject to high wind. The signal of the completion of anchoring could be sent to the remote control system through the wind protection control module.

The releasing anchoring process disclosed by the present invention comprises the following steps: if a releasing anchoring command is being received, the anti-displacement anchoring device enables the four anchoring plate cylinders disposed at the sea side and the dock side of the bridge crane to be retracted, so that the four anchoring plates are being pulled out from corresponding anchoring grooves; if the anchoring position sensing device detects that the anchoring plates are being pulled out from the anchoring grooves, the wind protection anchoring control module activates the driving device, the driving device drives the driven device to rotate to enable the pull rod body to revolve, further to descend relative to the pull rod nut; in descending, determining whether the lock pin reaches the preset stroke length that the lock pin should extend into the lock pin fixing groove, namely the plug-in height position c based on the detection of the position sensor; if yes, it is determined that the pin reaches the preset stroke length and then stopping the driving device; moving the bridge crane from the first opening to the second opening, and in the meanwhile detecting the current position of the bridge crane by the anchoring position sensing device; determining whether the bridge crane is at a preset release anchoring position; if yes, enabling the driving device to rotate along a reverse direction to drive the pull rod body ascend; determining whether the lock pin reaches to the anchor releasing height, namely the anchor releasing height mark a based on the detection of the position sensor; if yes, it is determined that the lock pin is fully retracted from the lock pin fixing groove, and then stopping the driving device. The pull rod body and the ground wind protection foundation are separated. Then the driving device is being fully stopped by the brake device to prevent from rotating or moving. As the anchoring of the wind protection pull rods is being released, the bridge crane is in the status of anchor releasing due to the fact that all of the four anchoring plates are being released, the bridge crane could move and execute normal operation.

The wind protection anchoring system and the wind protection anchoring method for bridge crane disclosed by the present invention is completely automated and during the whole without operators required, thereby reducing the number of workers in the field and maintenance cost. Therefore, the efficiency of port automation is improved.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What we claim is:

1. A wind protection anchoring system for a bridge crane comprising:

the bridge crane;

four wind protection pull rods mounted on both lateral sides of the bridge crane respectively at the sea side and the shore side;

four ground wind protection foundations fixedly formed on a port foundation corresponding to the four wind protection pull rods;

further comprising:

a wind protection anchoring control module;

wherein each wind protection pull rod comprises:

a driving device connected to a control output end of the wind protection anchoring control module;

a pull rod body provided with a driven device on a top end, wherein the driven device is in cooperation with the driving device and driven by the driving device to enable each pull rod body to rotate;

a pull rod nut configured to connect to each pull rod body with threads thereon and mounted on the bridge crane; and a lock pin fixed on a bottom end of each pull rod body;

wherein each ground wind protection foundation comprises:

a lock pin fixing groove formed thereon;

a fixing plate arranged on a slot of each lock pin fixing groove;

a first opening and a second opening which are adjacent to each other are opened on each fixing plate wherein the area of each first opening is configured to be smaller than the area of each second opening; each second opening configured to allow each lock pin to enter into the lock pin fixing groove upon descending and each first opening configured to block each lock pin from ascending within each lock pin fixing groove after being repositioned;

wherein the wind protection anchoring control module is configured to activate the driving device to enable the driven device to drive each pull rod body to rotate and descend relative to each pull rod body until each lock pin extends into each lock pin fixing groove through each second opening; and to drive the driving device to act along a reverse direction to enable each pull rod body to ascend until reaching to a wind protection anchoring height being blocked by each first opening after the bridge crane is repositioned along the direction from each second opening to each first opening to an anchorage; and to stop the driving device as each pull rod body ascends to the wind protection anchoring height and is blocked within each lock pin fixing groove to connect each pull rod body and each ground wind protection foundation.

2. The wind protection anchoring system for a bridge crane of claim 1, further comprising:

a limiting detecting device comprising:

a position sensor connected to the wind protection anchoring control module and mounted on each pull rod body; and a limiting rod mounted at the lower end of each pull rod nut and provided with an anchor releasing height mark, a wind protection anchoring height mark and a plug-in height mark from top to bottom.

3. The wind protection anchoring system for a bridge crane of claim 1, wherein the driving device comprises:

a first driving motor or a first driving hydraulic motor; and a first driving gear configured to be driven by the first driving motor or the first driving hydraulic motor to rotate, which is assembled with the driven device in mesh connection, wherein the driven device is a long straight-cut gear;

or the driven device comprising a driven gear being sleeved on a multi-faceted cylinder, fixedly arranged on the top end of each pull rod body.

4. The wind protection anchoring system for a bridge crane of claim 1, further comprising:

a fine adjustment device provided on each pull rod body configured to adjust the length of each pull rod body.

5. The wind protection anchoring system for a bridge crane of claim 1, further comprising:

a torque sensor configured to detect the driving torque on the driving device which is mounted on the driving device and connected to the wind protection control module.

6. The wind protection anchoring system for a bridge crane of claim 1, further comprising:

a bridge crane position detecting device comprising:

positioning sensing components arranged on the grounds beneath the bridge crane to mark a preset anchoring position of the bridge crane; and a positioning detecting antenna configured to detect the position of the positioning sensing components, which is mounted on the bridge crane and connected to the wind protection anchoring control module.

7. The wind protection anchoring system for a bridge crane of claim 1, further comprising:

a brake device configured to fully stop the driving device as the wind protection anchoring process is being completed, which is connected to the wind protection anchoring control module.

8. The wind protection anchoring system for a bridge crane of claim 1, further comprising:

an anti-displacement anchoring device comprising:

an anchoring groove formed on the port foundation corresponding to the sea side or the shore side of the bridge crane;

an anchoring plate;

an anchoring plate cylinder connected to the anchoring plate and configured to drive the anchoring plate to extend into the anchoring groove or retract from the anchoring groove; and an anchoring position sensing device configured to determine if the anchoring plate is extending into the anchoring groove or retracting from the anchoring groove.

9. A wind protection anchoring method applied in a wind protection anchoring system of claim 1, comprising:

receiving a wind protection anchoring command;

determining whether the four wind protection pull rods are being aligned with the four ground wind protection foundations; if yes, activating the driving device to enable the driven device to drive each pull rod body to rotate and descend relative to each pull rod nut;

determining whether each a-lock pin extending to a preset height in each lock pin fixing groove; if yes, determining whether the bridge crane is moving to a preset anchorage; if yes, enabling the driving device to act in a reverse direction driving the driven device to ascend;

detecting the driving torque on the driving device and determining whether the driving torque reaches to a set torque; if yes, stopping the driving device and enabling each lock pin to be blocked by each first opening and maintaining in each lock pin fixing groove to connect each pull rod body and each ground wind protection foundation.

10. The wind protection anchoring method of claim 9, as each pull rod body is fixedly connecting with each ground wind protection foundation, comprising:

receiving a releasing anchoring command;

activating the driving device to enable the driven device to drive each pull rod body to rotate and descend relative to each pull rod nut;

determining whether each lock pin reaches to the preset height in each lock pin fixing groove; if yes, determining whether the bridge crane is moving to a preset release anchoring position; if yes, enabling the driving device to rotate along a reverse direction to drive each pull rod body to ascend relative to each pull rod body;

determining whether each lock pin ascending to the anchor releasing height; if yes, stopping the driving device to separate each pull rod body from each ground wind protection foundation.

* * * * *